US005939691A

United States Patent [19]

Shiau

[11] Patent Number: 5,939,691

[45] Date of Patent: Aug. 17, 1999

[54] WATERPROOF SWITCH DEVICE FOR A BATTERY POWERED ELECTRIC APPLIANCE

[76] Inventor: Shoei-Shuh Shiau, No. 10, Alley 1, Lane 551, Sec. 1, Wan-Shou Rd., Guei-Shan Hsiang, Tao-Yuan Hsien, Taiwan

[21] Appl. No.: 09/190,062

[22] Filed: Nov. 12, 1998

[51] Int. Cl.[6] ..... H01H 13/06

[52] U.S. Cl. ..... 200/302.2; 362/205

[58] Field of Search ..... 200/302.1, 302.4; 362/205, 158

[56] References Cited

U.S. PATENT DOCUMENTS 4,843,526 6/1989 Price, III ..... 362/187

*Primary Examiner*—Michael L. Gellner
*Assistant Examiner*—Nhung Nguyen
*Attorney, Agent, or Firm*—Foley & Lardner

[57] ABSTRACT

A waterproof switch device includes a tubular housing with a through hole and front and rear barriers, which are disposed at two sides of the through hole and which have insert recesses. A switch body is inserted into the tubular housing, and is provided with a spring-loaded push button protruding out of the through hole. A tubular elastomeric member is sleeved and engages tightly the tubular housing between the barriers. A protrusion is vaunted from the elastomeric member to mate and receive the push button. A resilient retaining sheath member has two opposing lateral ends and an inner abutment wall between the lateral ends. The inner abutment wall mates and clamps the elastomeric member. Two inserted portions extend from and are outboard to the lateral ends respectively, and are fitted retainingly in the insert recesses so as to retain tightly the elastomeric member on the tubular housing.

5 Claims, 4 Drawing Sheets

WATERPROOF SWITCH DEVICE FOR A BATTERY POWERED ELECTRIC APPLIANCE

BACKGROUND OF THE INVENTION

1. Field of the Invention

This invention relates to a waterproof switch device, more particularly to a waterproof switch device for a battery powered electric appliance, such as a flashlight.

2. Description of the Related Art

Referring to FIG. 1, a conventional waterproof switch device for a battery powered electric appliance, e.g. a flashlight, is shown to comprise a tubular housing 11 with an accommodation chamber 14, a switch body 12 which is inserted into the accommodation chamber 14 and which has a push button 16 that is urged to protrude out of a through hole 15 in the tubular housing 11 immediately after the switch body 12 is inserted into the accommodation chamber 14, and a tubular elastomeric member 13 which is strapped around the tubular housing 11 for providing a waterproofing effect. A protrusion 17 is vaunted from the elastomeric member 13 to mate and receive the push button 16.

Since the elastomeric member 13 is still rotatable relative to the tubular housing 11 so that the protrusion 17 tends to move relative to the push button 16, water may enter the accommodation chamber 14 from the through hole 15. In addition, it is inconvenient to press the push button 16 by means of the protrusion 17.

Moreover, since there is no means for guiding the insertion of the switch body 12 into the tubular housing 11 and for retaining the former in the latter, the switch body 12 is inconveniently inserted into the accommodation chamber 14 and may be rotated therein after a period of use.

SUMMARY OF THE INVENTION

The object of the present invention is to provide a waterproof switch device which can prevent rotation of the tubular elastomeric member relative to the tubular housing for providing an excellent waterproofing effect.

Another object of the present invention is to provide a waterproof switch device which has means for guiding insertion of the switch body into the tubular housing and for preventing rotation of the former in the latter.

According to this invention, a waterproof switch device includes a tubular housing which has a through hole formed through an intermediate circumferential portion, and front and rear barriers at two sides of the through hole. The barriers have insert recesses which are aligned with each other to define a retaining groove therebetween. A switch body is inserted into the tubular housing, and is provided with a spring-loaded push button which is urged to protrude out of the through hole. A tubular elastomeric member has a second inner circumferential wall to sleeve and engage tightly the intermediate circumferential portion of the tubular housing between the barriers. The elastomeric member further has a second outer circumferential wall with upper and lower curved wall portions, and a protrusion which is vaunted from the second inner circumferential wall to mate and receive the push button. A resilient retaining sheath member has two opposing lateral ends and an inner abutment wall between the lateral ends. The inner abutment wall mates and clamps the second outer circumferential wall. Two inserted portions extend from and are outboard to the lateral ends respectively, and are aligned with each other to be fitted retainingly in the retaining groove between the insert recesses so as to retain tightly the elastomeric member on the tubular housing.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
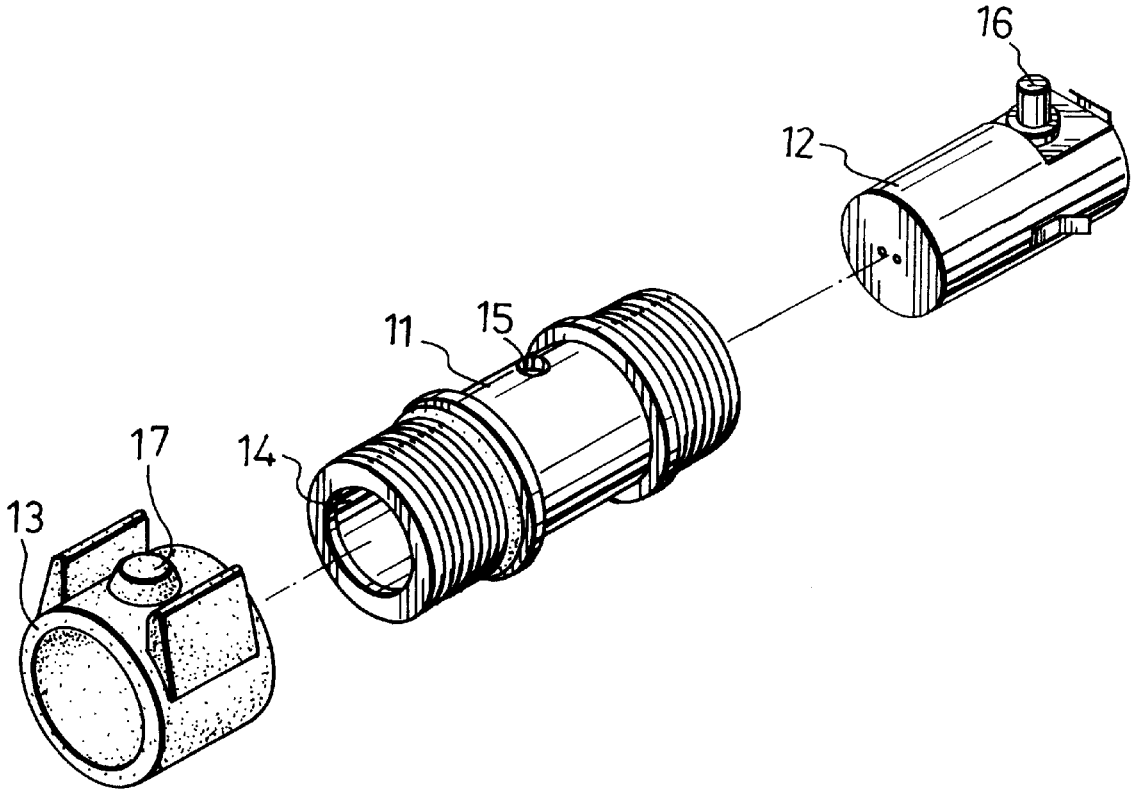
FIG. 1 PRIOR ART
FIG. 1 is an exploded view of a conventional waterproof switch device for a battery powered electric appliance.
Figure 2:
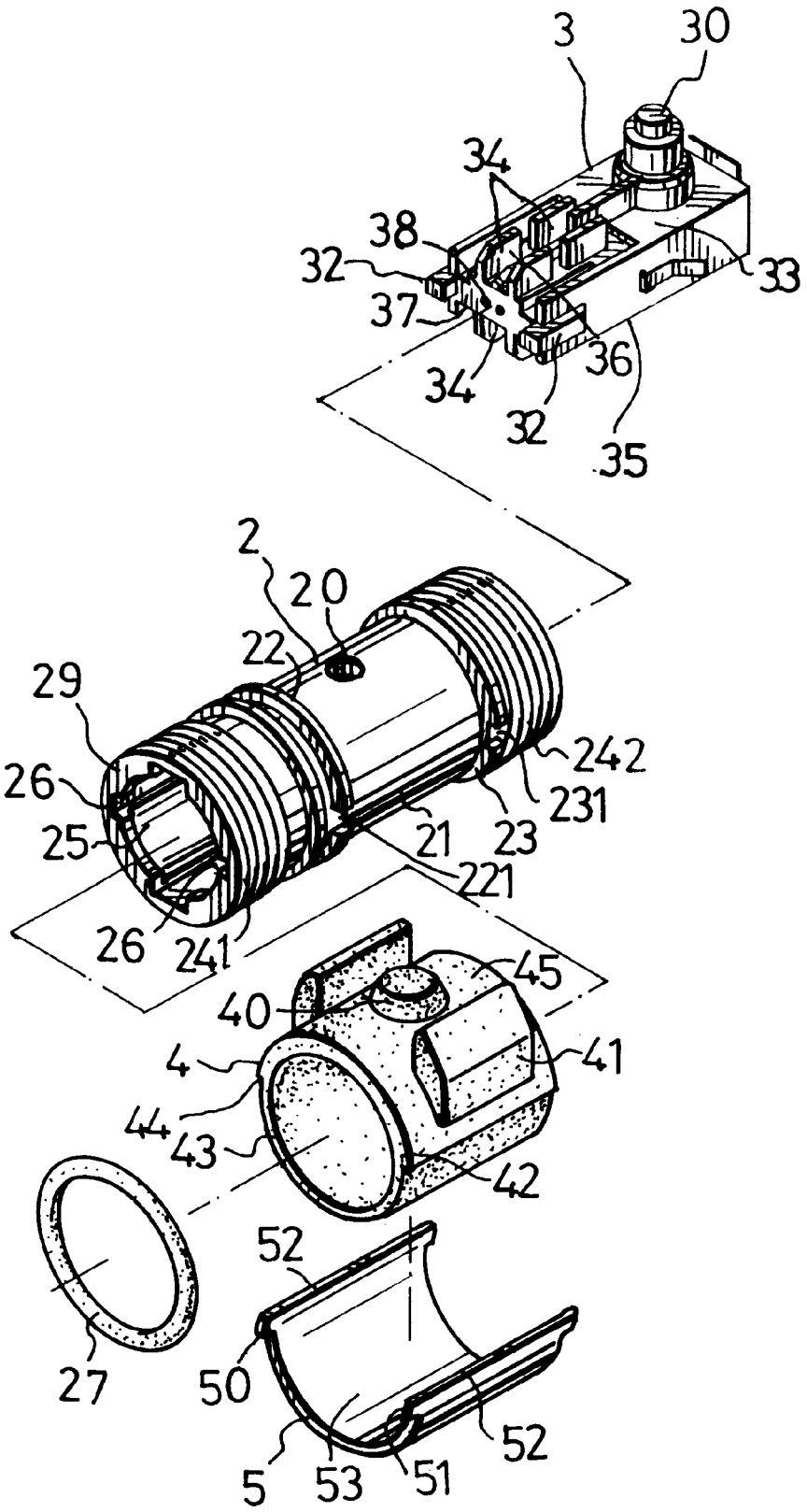
FIG. 2 is an exploded view of a preferred embodiment of a waterproof switch device according to this invention.
Figure 3:
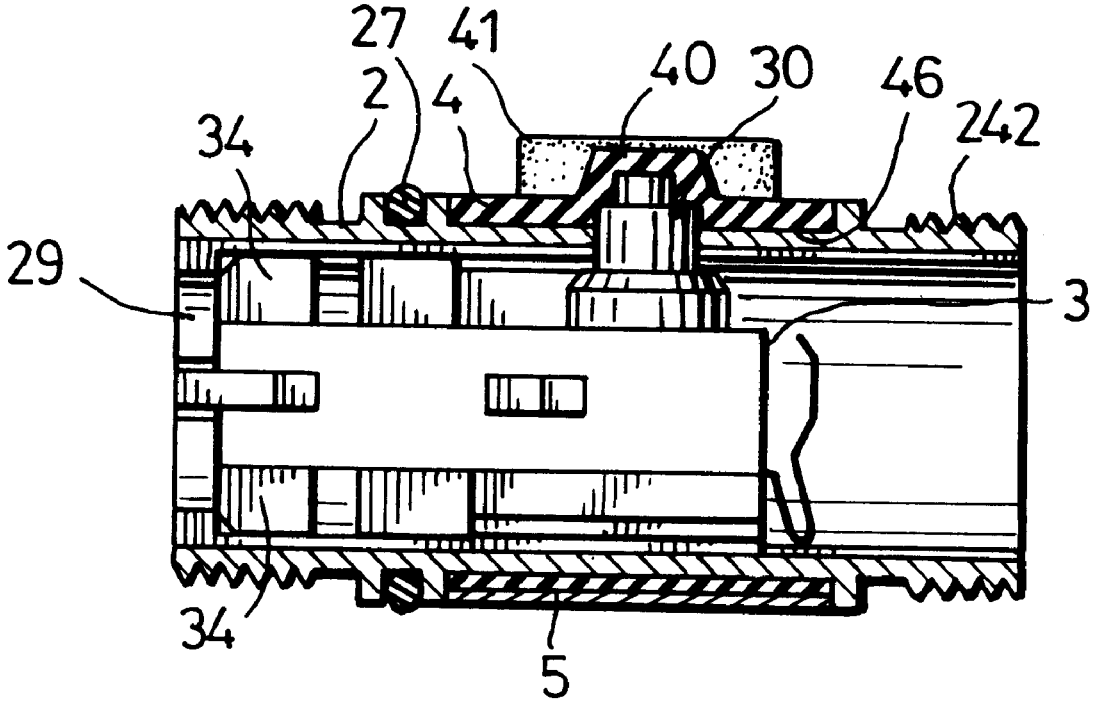
FIG. 3 is a longitudinal cross-sectional view of the preferred embodiment.

Referring to FIGS. 2 and 3, a preferred embodiment of a waterproof switch device according to the present invention is shown to comprise a tubular housing 2, a switch body 3, a tubular elastomeric member 4, and a retaining sheath member 5.

The tubular housing 2 has front and rear annular coupling portions 241,242 formed with threads, and an intermediate circumferential portion 21 which is disposed between the front and rear annular coupling portions 241,242 in a first axial direction. The intermediate circumferential portion 21 has a first outer circumferential wall with a first dimension, a first inner circumferential wall which defines an accommodation chamber 25, and a through hole 20 which is disposed in the first outer circumferential wall and which extends in a radial direction to be communicated with the first inner circumferential wall.

Front and rear barriers 22,23 extend respectively and radially from the first outer circumferential wall, and are located respectively between the through hole 20 and the front and rear annular coupling portions 241,242 so as to define a first longitudinal length therebetween in the first axial direction. The front and rear barriers 22,23 respectively include ring members which surround the first outer circumferential wall, and which have notches 221,231 that are aligned with each other to serve as insert recesses that define a retaining groove therebetween with a second longitudinal length. A resilient ring member 27 is strapped detachably around the first outer circumferential wall, and flanks immediately a front side of the ring member of the front barrier 22 which is distal to the through hole 20. An annular stop flange 29 extends diametrically and inwardly from an inner circumferential wall of the front annular coupling portion 241. In addition, two diametrically opposed longitudinal retaining grooves 26 are formed in inner circumferential walls of the front and rear annular coupling portions 241,242 and the intermediate circumferential portion 21, and extend in the first axial direction.

The switch body 3 is insertable from the rear annular coupling portion 242 into the accommodation chamber 25, and has two parallel guiding rails 32 which extend axially so as to be fitted in the retaining grooves 26 respectively to guide insertion of the switch body 3 into the accommodation chamber 25 and to prevent rotation of the switch body 3 relative to the first inner circumferential wall of the intermediate circumferential portion 21. In addition, by virtue of the stop flange 29, the switch body 3 can be prevented from being removed from the accommodation chamber 25. The switch body 3 has a front end face 37 with two through holes 38 for extension of terminals of a lamp (not shown), and a spring-loaded push button 30 which is disposed on an upper surface 33 thereof and which is urged to protrude out of the through hole 20 immediately after the switch body 3 is inserted into the accommodation chamber 25. Two pairs of spaced partitions 34 are formed respectively on the upper and lower surfaces 33,35 to confine receiving spaces 36 for receiving prepared lamps (not shown).

The elastomeric member 4 is sleeved on the intermediate circumferential portion 21 between the front and rear barriers 22,23, and defines a third longitudinal length in a second axial direction. The third longitudinal length is slightly larger than or equal to the first longitudinal length. The elastomeric member 4 is provided with second outer and second inner circumferential walls 45,46. The second inner circumferential wall 46 has a second dimension which is slightly less than the first dimension of the first outer circumferential wall of the intermediate circumferential portion 21 so as to engage tightly the first outer circumferential wall. The second outer circumferential wall 45 is provided with upper and lower curved wall portions 42,43 which are joined to complete the second outer circumferential wall 45 respectively at two left and right junctures that are spaced apart from each other and that extend in the second axial direction. The upper curved wall portion 42 has a protrusion 40 which is vaunted from the second inner circumferential wall 46 to mate and receive the push button 30.

The upper and lower curved wall portions 42,43 define respectively with the second inner circumferential wall 46 a first radial thickness and a second radial thickness that is thinner than the first radial thickness so as to form two axially extending shoulder surfaces 44 at the right and left junctures between the upper and lower curved wall portions 42,43. Two supports 41 are mounted on the upper curved wall portion 42.

Figure 4:
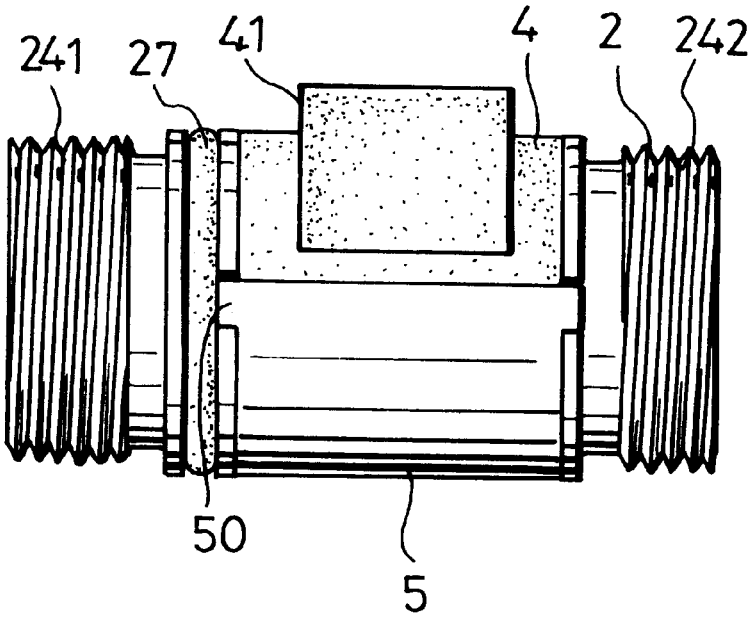
FIG. 4 is a side view the preferred embodiment.
Figure 5:
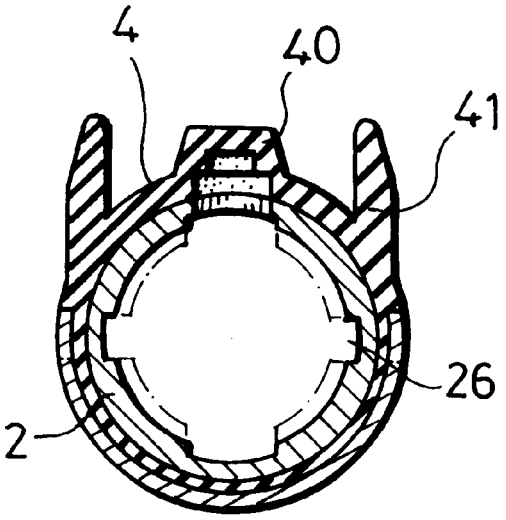
FIG. 5 is a transverse cross-sectional view of the preferred embodiment.

The retaining sheath member 5 is made of a resilient material, and has two opposing lateral ends 52 which extend in a longitudinal direction, and an inner abutment wall 53 between the lateral ends 52. The inner abutment wall 53 defines a fourth longitudinal length which is equal to the second longitudinal length of the retaining groove between the notches 221,231, and is shaped to embrace the lower curved wall portion 43 of the elastomeric member 4. In addition, the inner abutment wall 53 has a dimension that is slightly less than that of the lower curved wall portion 43 so as to mate and clamp the second outer circumferential wall 45. The retaining sheath member 5 further includes two inserted portions 50,51, each of which extends from and is outboard to a respective lateral end 52. The insert portions 50,51 are aligned with each other to define a hook portion with a fifth longitudinal length in the longitudinal direction that is equal to or less than the second longitudinal length of the retaining groove between the notches 221,231 so as to be fitted retainingly in the retaining groove. At the same time, the lateral ends 52 abut against the shoulder surfaces 44 respectively, as shown in FIGS. 4 and 5.

In use, the waterproof switch device of this invention is adapted to be assembled to an elongate body of a battery powered electric appliance, such as a flashlight (not shown). The elongate body includes a rear segment for housing a battery, and a front segment for holding a working member, such as a lamp, which is powered by the battery. The front and rear annular coupling portions 241,242 of the tubular housing 2 of the waterproof switch device according to this invention is adapted to couple with the rear and front segments of the elongate body. The push button 30 is adapted to control an electric connection between the battery and the working member.

As illustrated, the retaining sheath member 5 mates and clamps the second outer circumferential wall 45 of the elastomeric member 4, and the insert portions 50,51 are fitted retainingly in the retaining groove of the tubular housing 2 with the lateral ends 52 abutting against the shoulder surfaces 44 respectively, thereby preventing rotation of the elastomeric member 4 relative to the tubular housing 2 so as to ensure the waterproofing effect of the elastomeric member 4.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A waterproof switch device for a battery powered electric appliance that includes an elongate body which has a rear segment for housing a battery and a front segment for holding a working member powered by the battery, said waterproof switch device comprising:

a tubular housing having front and rear annular coupling portions which are adapted to couple with the rear and front segments, respectively, and an intermediate circumferential portion which is disposed between said front and rear annular coupling portions in a first axial direction, said intermediate circumferential portion having a first outer circumferential wall with a first dimension, a first inner circumferential wall which defines an accommodation chamber, and a through hole which is disposed in said first outer circumferential wall and which extends in a radial direction to be communicated with said first inner circumferential wall, said tubular housing further having front and rear barriers which extend respectively and radially from said first outer circumferential wall and which are located respectively between said through hole and said front and rear annular coupling portions so as to define a first longitudinal length therebetween in said first axial direction, said front and rear barriers respectively having insert recesses which are aligned with each other in said first axial direction to define a retaining groove therebetween with a second longitudinal length in said first axial direction;

a switch body insertable from said rear annular coupling portion into said accommodation chamber and non-rotatable relative to said first inner circumferential wall, said switch body being provided with a spring-loaded push button which is adapted to control an electric connection between the battery and the working member, and which is urged to protrude out of said through hole immediately after said switch body is inserted into said accommodation chamber;

a tubular elastomeric member defining a third longitudinal length in a second axial direction, said third longitudinal length being slightly larger than or equal to said first longitudinal length, said elastomeric member being provided with second outer and second inner circumferential walls, said second inner circumferential wall having a second dimension which is slightly less than said first dimension so as to engage tightly said first outer circumferential wall when said elastomeric member is sleeved on said intermediate circumferential portion between said front and rear barriers, said second outer circumferential wall being provided with upper and lower curved wall portions which are joined to complete said second outer circumferential wall respectively at two left and right junctures that are spaced apart from each other and that extend in said second axial direction, said upper curved wall portion having a protrusion vaunted from said second inner circumferential wall to mate and receive said push button; and a retaining sheath member made of a resilient material, and having two opposing lateral ends which extend in a longitudinal direction, and an inner abutment wall between said lateral ends, said inner abutment wall defining a fourth longitudinal length which is equal to said second longitudinal length, said inner abutment wall being shaped to embrace said lower curved wall portion of said elastomeric member, and having a dimension slightly less than that of said lower curved wall portion so as to mate and clamp said second outer circumferential wall, said retaining sheath member further including two inserted portions, each of which is disposed to extend from and outboard to a respective one of said lateral ends, said inserted portions being aligned with each other to define a hook portion that has a fifth longitudinal length in said longitudinal direction, said fifth longitudinal length being equal to or less than said second longitudinal length so as to be fitted retainingly in said retaining groove once said retaining sheath member is brought to clamp said second outer circumferential wall of said elastomeric member.

2. The waterproof switch device as claimed in claim 1, wherein said upper and lower curved wall portions define respectively with said second inner circumferential wall a first radial thickness and a second radial thickness that is thinner than said first radial thickness so as to form two axially extending shoulder surfaces at said right and left junctures between said upper and lower curved wall portions, said lateral ends abutting respectively against said shoulder surfaces when said inner abutment wall of said retaining sheath is brought to clamp said lower curved wall portion.

3. The waterproof switch device as claimed in claim 2, wherein said front barrier includes a first ring member which surrounds said first outer circumferential wall and which has a notch extending in said first axial direction so as to interrupt said first ring member, said first ring member having a front side distal to said through hole, said front barrier further including a second resilient ring member which is strapped detachably around said first outer circumferential wall and which flanks immediately said front side of said first ring member so as to form said insert recess with said notch.

4. The waterproof switch device as claimed in claim 1, wherein said front and rear annular coupling portions have inner circumferential walls which are connected to said first inner circumferential wall of said intermediate circumferential portion, said tubular housing having two diametrically opposed longitudinal retaining grooves which are formed in said inner circumferential walls of said front and rear annular coupling portions and said first inner circumferential wall of said intermediate circumferential portion, each of said longitudinal retaining grooves extending in said first axial direction, said switch body further having two parallel guiding rails which extend axially so as to be fitted in said retaining grooves respectively to guide insertion of said switch body into said accommodation chamber and to prevent rotation of said switch body relative to said first inner circumferential wall.

5. The waterproof switch device as claimed in claim 4, wherein said front annular coupling portion has an annular stop flange which extends diametrically and inwardly from said inner circumferential wall of said front annular coupling portion so as to prevent removal of said switch body from said accommodation chamber.

* * * * *